US007950957B1

(12) United States Patent
Yang

(10) Patent No.: US 7,950,957 B1
(45) Date of Patent: May 31, 2011

(54) COAXIAL CONNECTOR WITH A COMPRESSION RING BETWEEN A SLEEVE AND A SHEATH OF THE COAXIAL CABLE

(75) Inventor: Kuo-Chang Yang, Taipei County (TW)

(73) Assignee: BNS Precision Industry Co., Ltd., Shulin (TW)

( * ) Notice: Subject to any disclaimer, the term of this patent is extended or adjusted under 35 U.S.C. 154(b) by 0 days.

(21) Appl. No.: 12/645,666

(22) Filed: Dec. 23, 2009

(51) Int. Cl.
*H01R 9/05* (2006.01)

(52) U.S. Cl. ..... 439/578

(58) Field of Classification Search ..... 439/578–585, 439/271, 274, 275
See application file for complete search history.

(56) References Cited

U.S. PATENT DOCUMENTS

| | | | | |
|---|---|---|---|---|
| 7,785,144 | B1 * | 8/2010 | Islam | 439/583 |
| 2007/0015406 | A1 * | 1/2007 | Chawgo | 439/578 |
| 2008/0194143 | A1 * | 8/2008 | Holliday | 439/584 |
| 2010/0261380 | A1 * | 10/2010 | Skeels et al. | 439/584 |
| 2010/0273351 | A1 * | 10/2010 | Holliday | 439/584 |

* cited by examiner

*Primary Examiner* — Chandrika Prasad
(74) *Attorney, Agent, or Firm* — Bacon & Thomas, PLLC

(57) ABSTRACT

A connector for a coaxial cable is provided. The connector comprises a sleeve and a sealing device. The sleeve is adapted to be inserted over the coaxial cable. The sealing device is adapted to be interposed between the sleeve and a sheath of the coaxial cable to seal the coaxial cable for preventing rain, moisture and dust from entering into the coaxial cable, thereby further ensuring the transfer efficiency and reducing the loss rate of the signal.

8 Claims, 5 Drawing Sheets

COAXIAL CONNECTOR WITH A COMPRESSION RING BETWEEN A SLEEVE AND A SHEATH OF THE COAXIAL CABLE

CROSS-REFERENCES TO RELATED APPLICATIONS

Not applicable.

BACKGROUND OF THE INVENTION

1. Field of the Invention

The present invention relates to a connector, and in particular, to a connector for a coaxial cable.

2. Descriptions of the Related Art

Nowadays, many instruments and apparatuses adopt coaxial cables as a medium for signal transmission. For example, a television system such as a cable television system, a common antenna system or a direct broadcast satellite television system is generally connected to a signal dispatcher through a trunk or a low-noise block (LNB) and then, through the signal dispatcher, connected to a client to receive signals transmitted by the television system. The coaxial cable for transmission is provided with a coaxial cable connector at both a front end and a back end thereof respectively so that the dispatcher and the client can be connected through the coaxial cable to display a frame on a television set.

There is a variety of coaxial cable connectors, for example, the F-type, the BNC type, the LEC type and the RCA type connectors. Herein, the prior art will be illustrated with reference to the most commonly used F-type connector. Referring to FIG. 1, a conventional F-type coaxial cable connector 9 comprises a connection fitting 90, an inlet end 91, an inner tubular shaft 92 and a pinch tube 93. A section of coaxial cable A, with the sheath A4 thereof being striped off, is inserted from the inlet end 91 of the connector 9. The inner tubular shaft 92 is adapted to allow a central conductor A1 and an insulation layer A2 of the coaxial cable A to be inserted into the inner tubular shaft 92, with an isolation mesh A3 and a sheath A4 being received between the inner tubular shaft 92 and the pinch tube 93. Finally, a hexagonal gripper (not shown) is used to apply a pressure onto the pinch tube 93 to from a sealing connection between the pinch tube 93 and the sheath A4 of the coaxial cable A.

When such a connector 9 is connected to the coaxial cable A, gaps tend to exist between the pinch tube 93 and the coaxial cable A to cause easy entry of rain, moisture and dust through the inlet end 91, which not only adversely affects transmission of signals but may also cause damage to a dispatcher connected with the connector. Therefore, improvement has to be made thereon.

In view of this, it is highly desirable in the art to provide a connector capable of sealing gaps between the connector and a coaxial cable so as to ensure transmission of signals and prolong the service life of the dispatcher by preventing entry of rain, moisture and dust.

SUMMARY OF THE INVENTION

An objective of the present invention is to provide a connector capable of sealing gaps between the connector and a coaxial cable so as to ensure the transmission efficiency of signals and reduce loss of the dispatcher by effectively preventing entry of rain, moisture and dust.

To this end, the coaxial cable connector of the present invention comprises a sleeve and a sealing device. The sleeve is adapted to be inserted over a coaxial cable, and the sealing device is adapted to be interposed between the sleeve and a sheath of the coaxial cable to seal the coaxial cable.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 4:
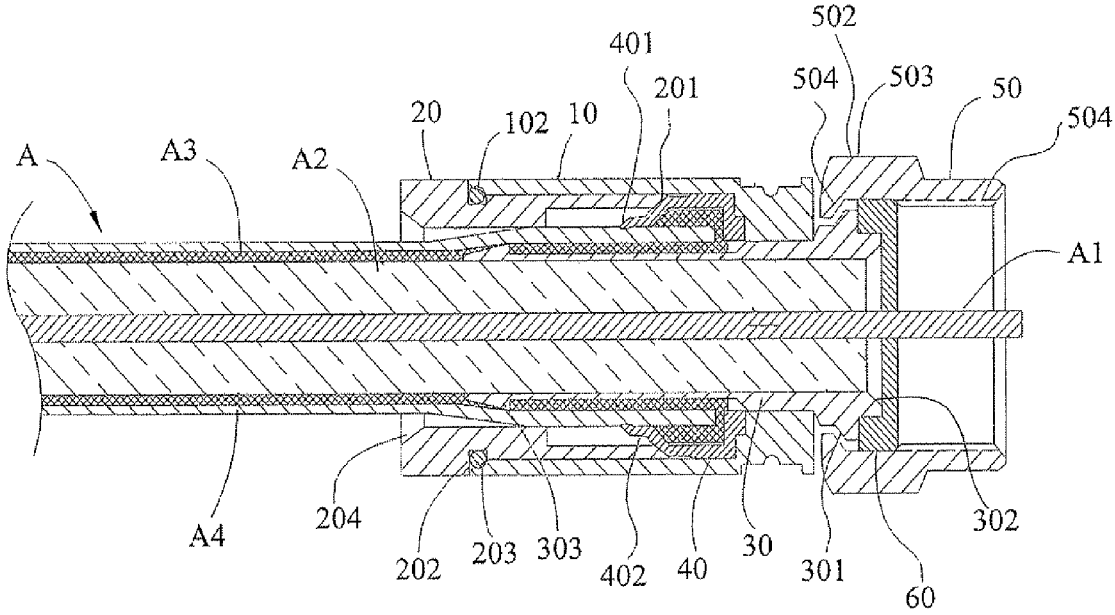
FIG. 4 is a cross-sectional view of the connector of the present invention connected with a coaxial cable.

Referring to FIG. 4, a connector 1 for a coaxial cable A according to the present invention seals the coaxial cable A by using a sealing device and a sleeve 10 in combination. The sleeve 10 is adapted to be inserted over the coaxial cable A, and the sealing device is adapted to be interposed between the sleeve 10 and a sheath A4 of the coaxial cable A to seal the coaxial cable A.

Figure 1:
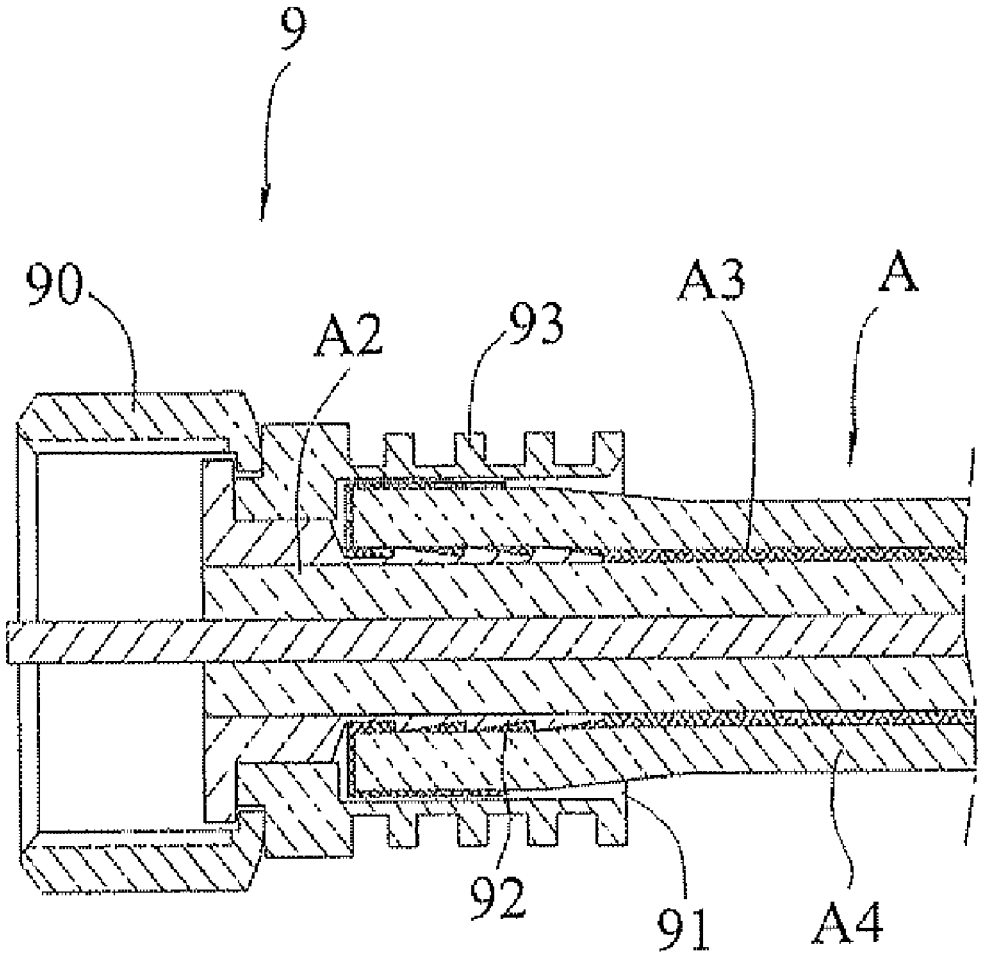
FIG. 1 is a cross-sectional view of a conventional F-type coaxial cable connector.
Figure 2:
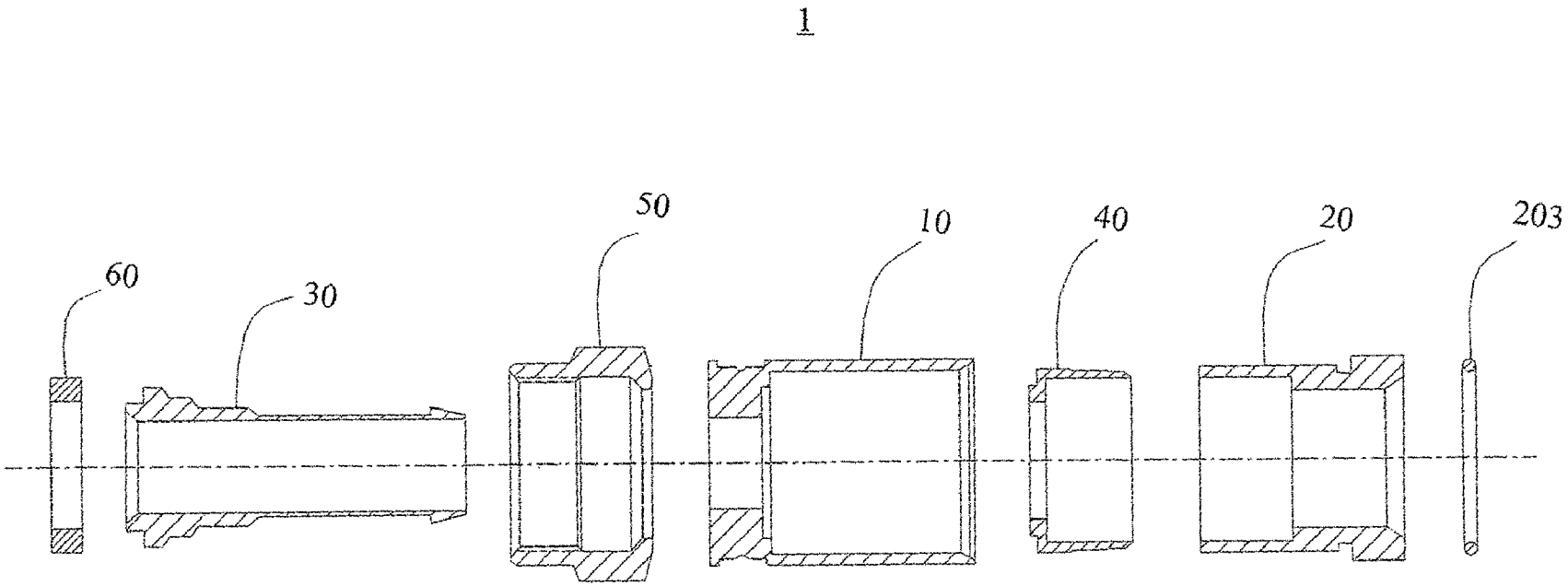
FIG. 2 is a cross-sectional exploded view of a connector of the present invention.
Figure 3:
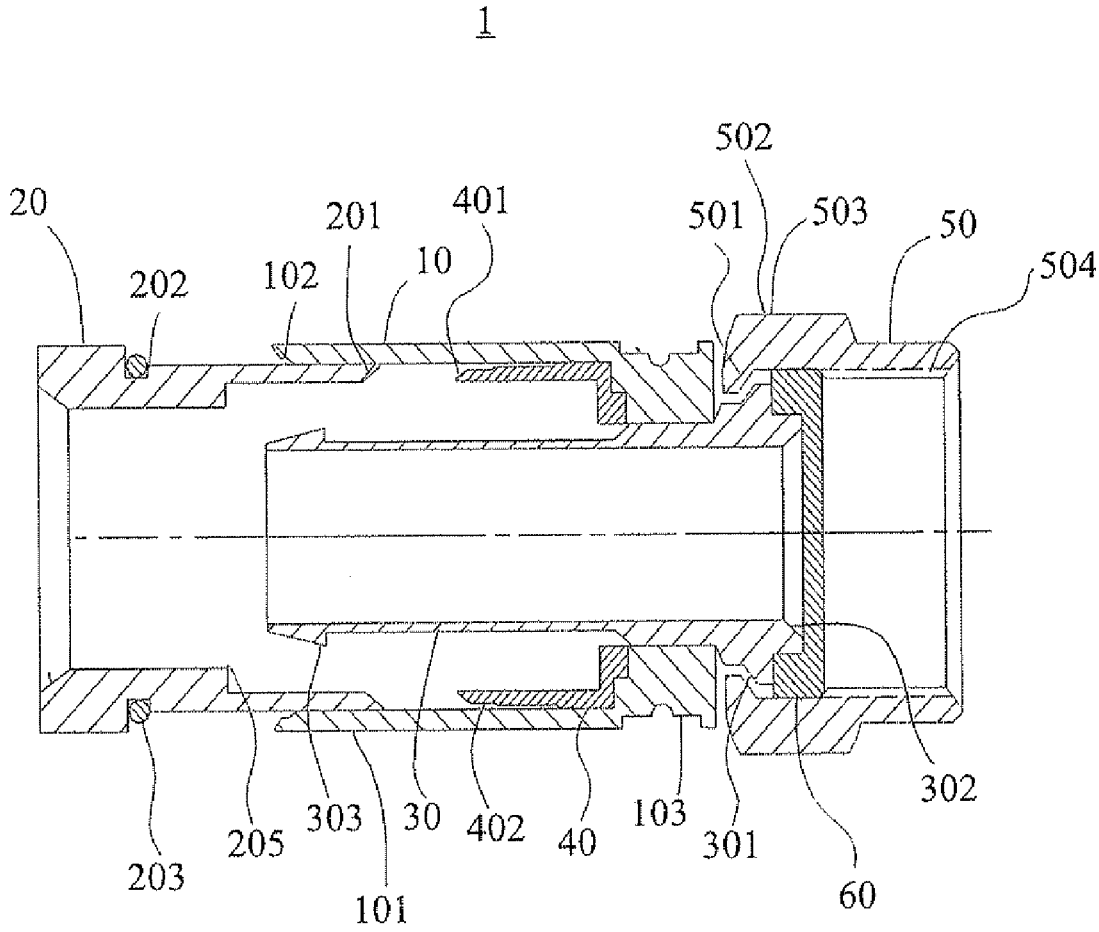
FIG. 3 is a cross-sectional assembled view of the connector of the present invention.

Specifically, referring to FIGS. 2 and 3, the sealing device of the present invention comprises a compression ring 20 and a first elastic ring 40, and the connector 1 further comprises an inner tubular shaft 30, a connection fitting 50 and a second elastic ring 60. The first elastic ring 40 is inserted from a cable inlet end 101 of the sleeve 10 and abuts against an inner tubular shaft inlet end 103 and an inner wall of the sleeve 10. The inner tubular shaft 30 is inserted into the connection fitting 50 from a cable outlet end 502 of the connection fitting 50, and then inserted into the sleeve 10 from the inner tubular shaft inlet end 103 of the sleeve 10. An engaging layer 301 of the inner tubular shaft 30 and a blocking layer 501 of the connection fitting 50 abut against each other so that the connection fitting 50 is annually disposed around a cable outlet end 302 of the inner tubular shaft 30 and is able to rotate freely about the inner tubular shaft 30 without being detached therefrom. The compression ring 20 is inset into the sleeve 10 from the cable inlet end 101 of the sleeve 10. The second elastic ring 60 is disposed in the connection fitting 50, abuts against both a thread 504 of the connection fitting 50 and the cable outlet end 302 of the inner tubular shaft 30, and encloses the cable outlet end 302 of the inner tubular shaft 30.

In practical use, the connector 1 of the present invention is joined to the coaxial cable A with an effect of sealing the coaxial cable A, as shown in FIGS. 3 and 4. The coaxial cable A comprises a central conductor A1, an insulation layer A2, an isolation mesh A3 and a sheath A4. Before the connector 1 and the coaxial cable A are joined with each other, the sheath A4 of the coaxial cable A shall be stripped off to separate the sheath A4 and the isolation mesh A3 of the coaxial cable A from the insulation layer A2 and the central conductor A1 of the coaxial cable A into two parts and to expose the central conductor A1.

In the process of joining the connector 1 of the present invention to the coaxial cable A, the coaxial cable A is firstly inserted through the compression ring 20 from an inlet end 204 of the compression ring 20 and then into the inner tubular shaft 30, and is separated into two portions by a tapered bevel 303 of the inner tubular shaft 30; i.e., the insulation layer A2 and the central conductor A1 of the coaxial cable A are inserted into the inner tubular shaft 30 while the isolation mesh A3 and the sheath A4 of the coaxial cable A are separated out to wrap around the inner tubular shaft 30. Then, the insulation layer A2 and the central conductor A1 of the coaxial cable A are further pushed forward in the inner tubular shaft 30 until the central conductor A1 is extended out of the cable outlet end 302 of the inner tubular shaft 30 and the cable outlet end 502 of the connection fitting 50 and is exposed inside the connection fitting 50. At this point, the inner tubular shaft 30 is interposed between the insulation layer A2 and the isolation mesh A3 of the coaxial cable A.

Then, the compression ring 20 is inserted from the cable inlet end 101 of the sleeve 10 and interposed between the sleeve 10 and the sheath A4 of the coaxial cable A. When the compression ring 20 is inserted into the sleeve 10, the first elastic ring 40 is adapted to be interposed between the sleeve 10, the compression ring 20 and the inner tubular shaft 30 for purpose of sealing. Preferably, the compression ring 20 and the first elastic ring 40 have a chamfer 201 and a chamfer 401 respectively. By pressing the compression ring 20 into the sleeve 10, the chamfer 201 of the compression ring 20 and the chamfer 401 of the first elastic ring 40 will contact with each other to guide the first elastic ring 40 to press against the sheath A4 of the coaxial cable A. At this point, a step layer 402 of the first elastic ring 40 is pressed towards an exterior wall of the inner tubular shaft 30 to tightly wrap around the sheath A4 and the isolation mesh A3. Furthermore, the compression ring 20 is preferably formed with a narrowed portion 205 disposed at the inlet end 204 of the compression ring 20. The narrowed portion 205 is adapted to compress the sheath A4 of the coaxial cable A so that the sheath A4 is pressed against the tapered bevel 303 to a greater extent to provide a desirable sealing effect.

Further speaking, preferably, the sleeve 10 is formed with an annular groove 102 on an interior surface thereof near the cable inlet end 101, and correspondingly, the compression ring 20 is also fowled with an annular groove 202 on an exterior surface thereof near the inlet end 204. The connector 1 of the present invention further comprises a colored O-ring 203 inset into the annular groove 202 of the compression ring 20 correspondingly. When the compression ring 20 is inset into the sleeve 10 with the annular groove 102 of the sleeve 10 facing towards the annular groove 202 of the compression ring 20, the O-ring 203 is adapted to be interposed between the annular groove 102 of the sleeve 10 and the annular groove 202 of the compression ring 20 to ensure sealing of the gap generated between the compression ring 20 and the sleeve 10 and to allow the compression ring 20 and the sleeve 10 for sliding relatively to each other. Furthermore, the second elastic ring 60 of the connector 1 of the present invention is disposed inside the connection fitting 50 and over the cable outlet end 302 of the inner tubular shaft 30, and the second elastic ring 60 is inserted over the central conductor A1 of the coaxial cable A and encloses the cable outlet end 302 of the inner tubular shaft 30 to result in sealing of the gap between the central conductor A1, the inner tubular shaft 30 and the connection fitting 50. In this embodiment, the second elastic ring 60 may be, for example, a flat rubber ring.

Figure 5:
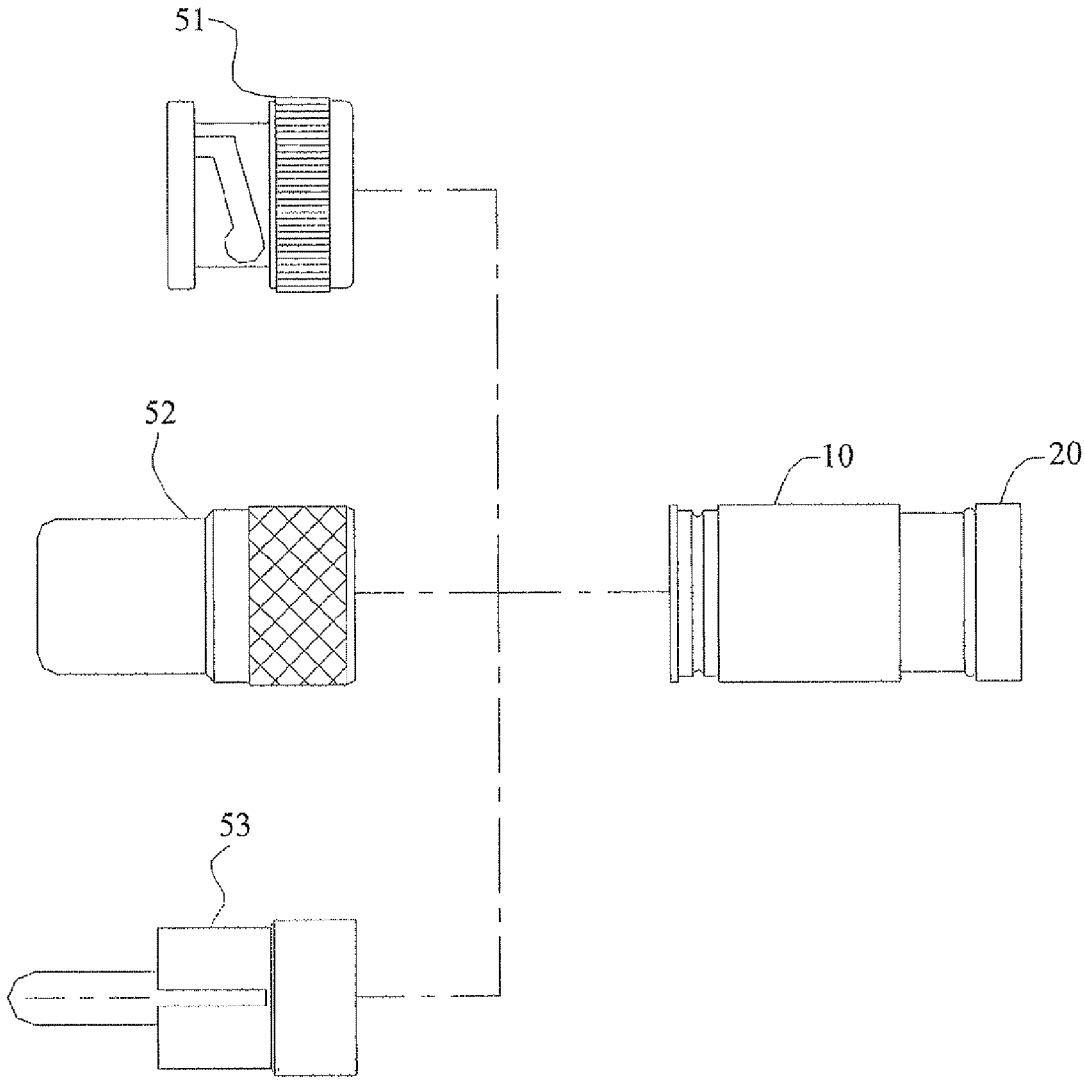
FIG. 5 is a schematic view of the connector of the present invention applied with different connection fittings.

In this embodiment, as shown in FIGS. 2 to 4, if the connection fitting 50 of the connector 1 is an F-type coaxial cable connection fitting, the exterior of the connection fitting 50 is formed into a hexagon 503 and is formed with threads 504 on an inner wall thereof to facilitate connection with other corresponding coaxial cable connectors. However, the type of the connection fitting 50 of the connector 1 is not limited herein, and the connector 1 of the present invention may be provided with other types of connection fittings. For instance, referring to FIG. 5, the connection fitting 50 may also be replaced with a BNC connection fitting 51, an IEC connection fitting 52, an RCA connection fitting 53 or other forms of coaxial cable connection fittings that may be used in the art.

In summary, as compared to the conventional coaxial cable connector, the connector of the present invention is able to seal the gap generated when the connector is joined with a coaxial cable, thereby preventing entry of rain, moisture and dust into the connector more effectively. This can ensure the transmission efficiency of signals and reduce loss of the dispatcher to improve competitiveness of the product.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A connector for a coaxial cable comprising a sheath, an insulation layer and an isolation mesh, the isolation mesh being sandwiched between the sheath and the insulation layer, the connector comprising:

a sleeve adapted to be inserted over the coaxial cable, wherein the sleeve has a cable inlet end, and the coaxial cable is adapted to be inserted into the sleeve from the cable inlet end;

a sealing device, being adapted to be interposed between the sleeve and the sheath of the coaxial cable to seal the coaxial cable, wherein the sealing device comprises a compression ring inserted into the sleeve from the cable inlet end of the sleeve and interposed between the sleeve and the sheath of the coaxial cable; and an inner tubular shaft adapted to be inserted into the coaxial cable and interposed between the insulation layer of the coaxial cable and the isolation mesh of the coaxial cable;

wherein the sealing device further comprises a first elastic ring interposed between the sleeve, the compression ring and the inner tubular shaft.

2. The connector as claimed in claim 1, wherein the coaxial cable comprises a central conductor, the connector further comprises a connection fitting and a second elastic ring, the inner tubular shaft has a cable outlet end, the connection fitting is annularly disposed around the cable outlet end of the inner tubular shaft, the central conductor is adapted to be extended out of the cable outlet end and exposed inside the connection fitting, and the second elastic ring is adapted to be disposed inside the connection fitting and over the cable outlet end of the inner tubular shaft and inserted over the central conductor.

3. The connector as claimed in claim 2, wherein the second elastic ring is a flat rubber ring.

4. The connector as claimed in claim 2, wherein the compression ring has a chamfer, and the first elastic ring also has a chamfer, and the chamfer of the compression ring and the chamfer of the first elastic ring are adapted to contact with each other to guide the first elastic ring to press against the sheath of the coaxial cable.

5. The connector as claimed in claim 2, wherein the compression ring is formed with a narrowed portion disposed at an inlet end of the compression ring, the compression ring is inserted by the coaxial cable from the inlet end, and the narrowed portion is adapted to press against the sheath of the coaxial cable.

6. The connector as claimed in claim 2, wherein the connector further comprises an O-ring, an exterior surface of the compression ring is formed with an annular groove correspondingly, and the O-ring is adapted to be interposed between the annular groove of the compression ring and the annular groove of the sleeve.

7. The connector as claimed in claim 6, wherein the O-ring is a colored O-ring.

8. The connector as claimed in claim 1, wherein the connection fitting is an F-type connection fitting, an BNC connection fitting, an IEC connection fitting or an RCA connection fitting.

* * * * *